United States Patent [19]

Hodges

[11] 4,075,077

[45] Feb. 21, 1978

[54] ELECTROLYTIC CELL

[75] Inventor: Jimmie Ray Hodges, Benton, Ky.

[73] Assignee: Pennwalt Corporation, Philadelphia, Pa.

[21] Appl. No.: 796,946

[22] Filed: May 16, 1977

[51] Int. Cl.[2] ..... B01K 3/00

[52] U.S. Cl. ..... 204/269; 204/275

[58] Field of Search ..... 204/275, 269, 270

[56] References Cited

U.S. PATENT DOCUMENTS 3,824,172 7/1974 Hodges ..... 204/269

*Primary Examiner*—Charles F. LeFevour

*Attorney, Agent, or Firm*—Charles N. Quinn

[57] ABSTRACT

An electrolytic cell for production of alkali metal chlorates has pairs of spaced flat parallel perforate cathodes and has flat imperforate anodes resident within each pair of cathodes, with each cathode having a plurality of horizontal slots therethrough, within an electrically conductive tank. Electrically insulative chemically resistive bumpers on either side of each anode maintain the anode spaced from the pair of cathodes within which the anode resides. The cell bottom and two sides are formed of a single member; the cell top is electrically insulated from the remainder of the cell.

12 Claims, 9 Drawing Figures

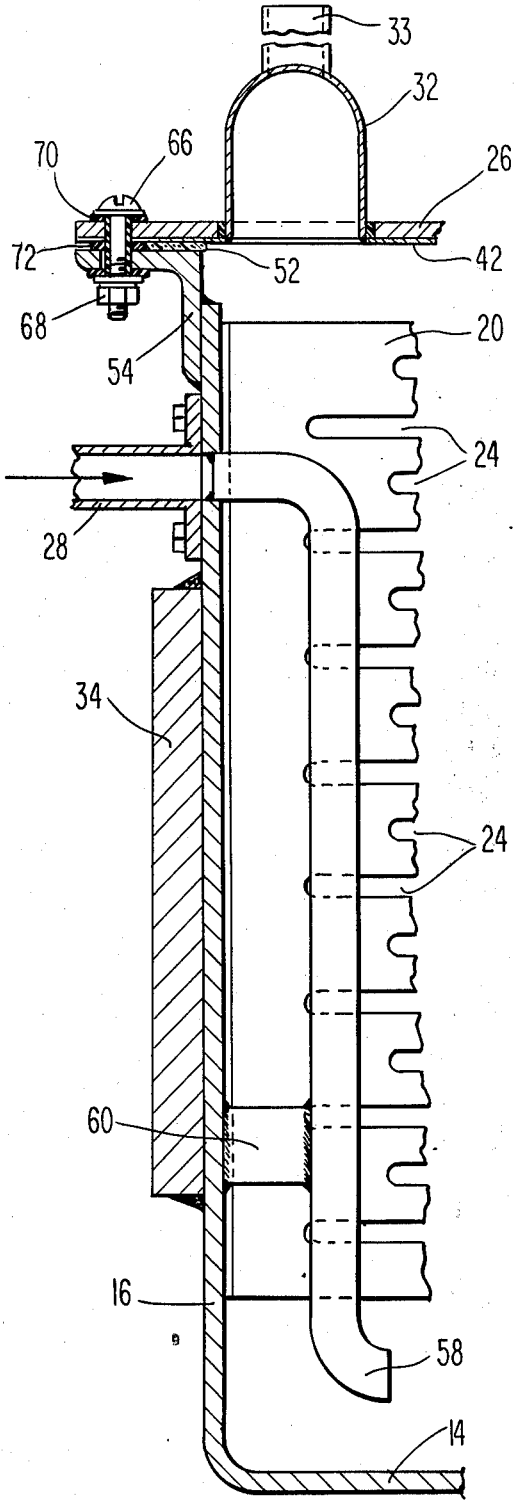
Fig. 6
Fig. 7
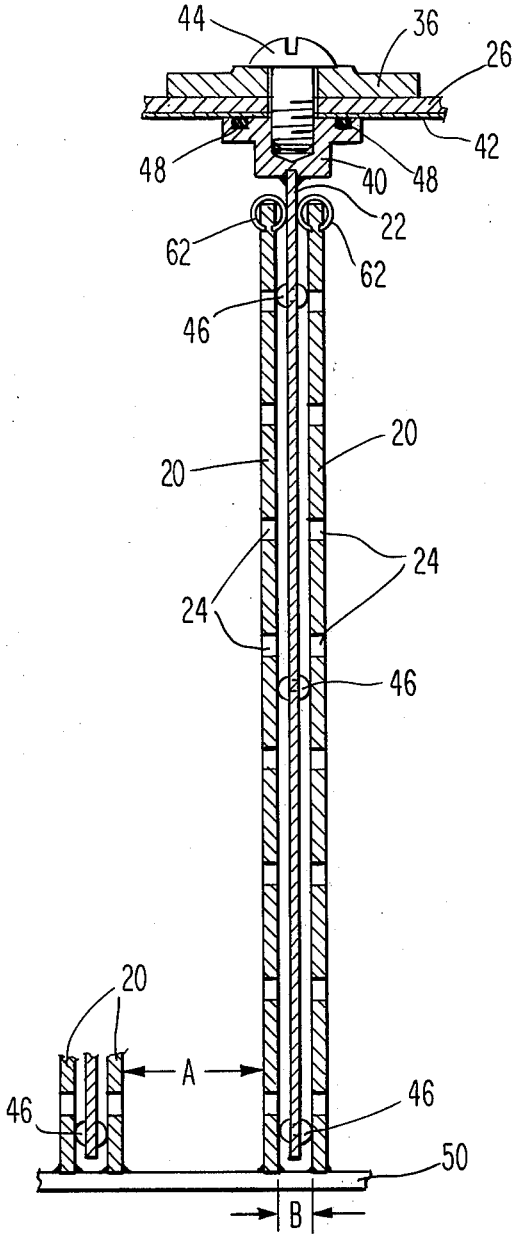
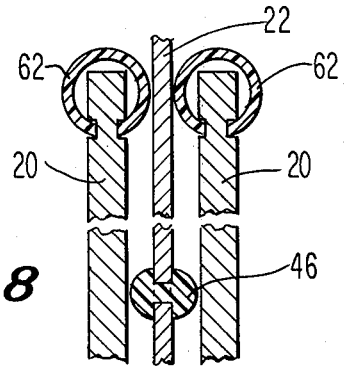
Fig. 8

ELECTROLYTIC CELL

BACKGROUND OF THE INVENTION

This invention relates to diaphragmless electrolytic cells for manufacture of alkali metal chlorates.

DESCRIPTION OF THE PRIOR ART

An electrolytic cell of the type to which this invention relates is illustrated in United States Pat. No. 3,824,172, Electrolytic Cell for Alkali Metal Chlorates. The 172 patent cell has substantially flat hollow electrode modules in an electrically conductive tank, with each module including cathodes on either side of anodes such that the pattern of cathodes and anodes is cathode-anode-cathode-cathode-anode-cathode-cathode-anode-cathode, etc. The 172 cathodes are foraminous, having vertically oriented slots.

SUMMARY OF THE INVENTION

This invention provides a cell for producing alkali metal chlorates which consumes less power than prior cells while operating at high electrode current density, thereby producing alkali metal chlorates more efficiently than cells known heretofore. The cell includes pairs of spaced perforate cathodes with flat imperforate anodes residing within each pair of cathodes. Each cathode has horizontal slots therethrough; the cathode and anode electrodes are in an electrically conductive tank. Electrically insulative chemically resistive bumpers on either side of each anode maintain the anodes proximate yet spaced from a pair of cathodes within which an anode resides. The tank bottom and two sides are a single member; the tank top is electrically insulated from the remainder of the tank.

BRIEF DESCRIPTION OF THE DRAWINGS

FIG. 6 is a partial sectional view taken as indicated by arrows 6—6 in FIG. 4.

FIG. 7 is a partial sectional view taken as indicated by arrows 7—7 in FIG. 5.

FIG. 8 is an enlarged partial view of structure illustrated in FIG. 7.

DESCRIPTION OF THE PREFERRED EMBODIMENTS

Figure 3:
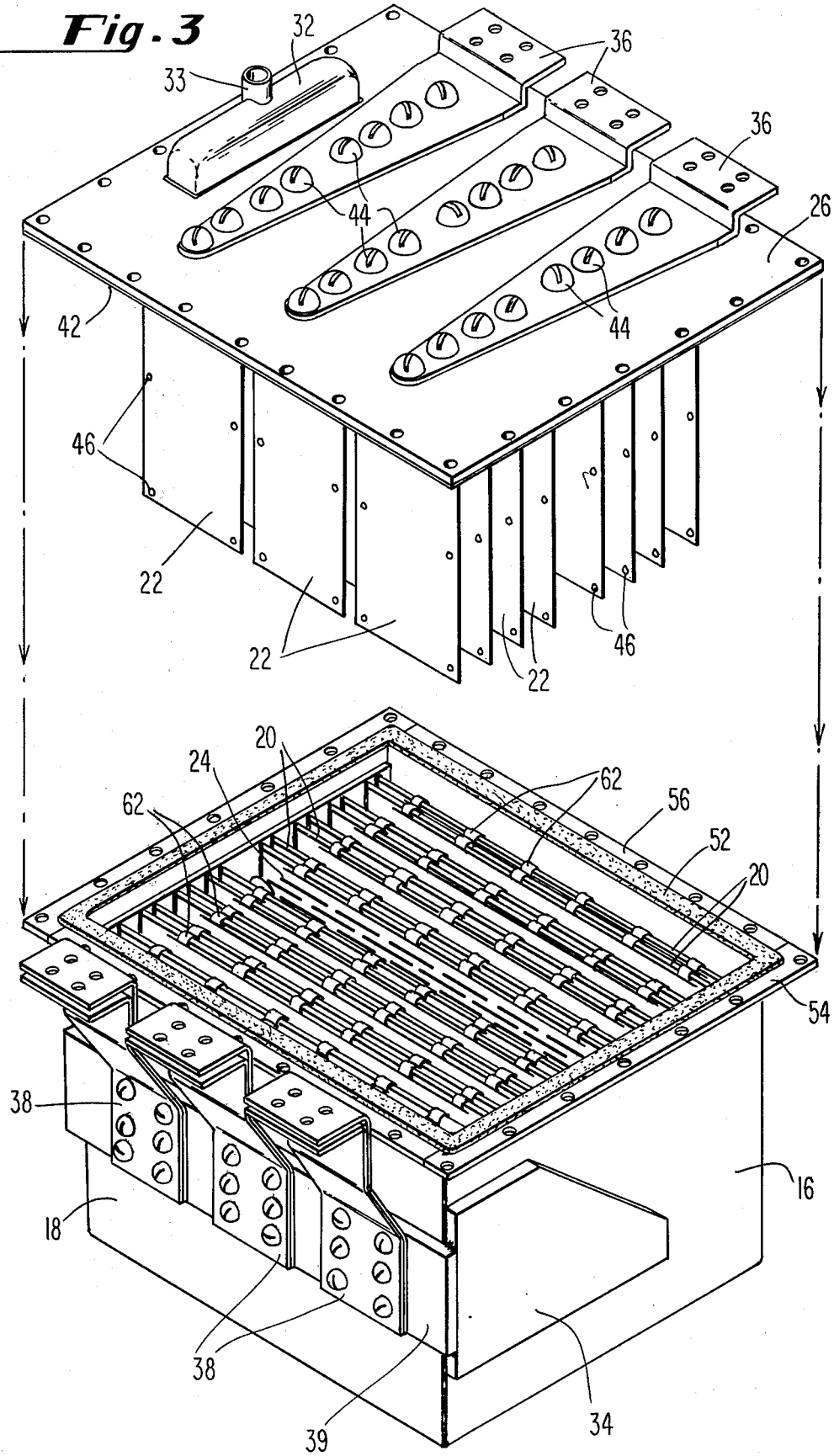
FIG. 3 is an exploded isometric view of a single cell embodying the invention.
Figure 5:
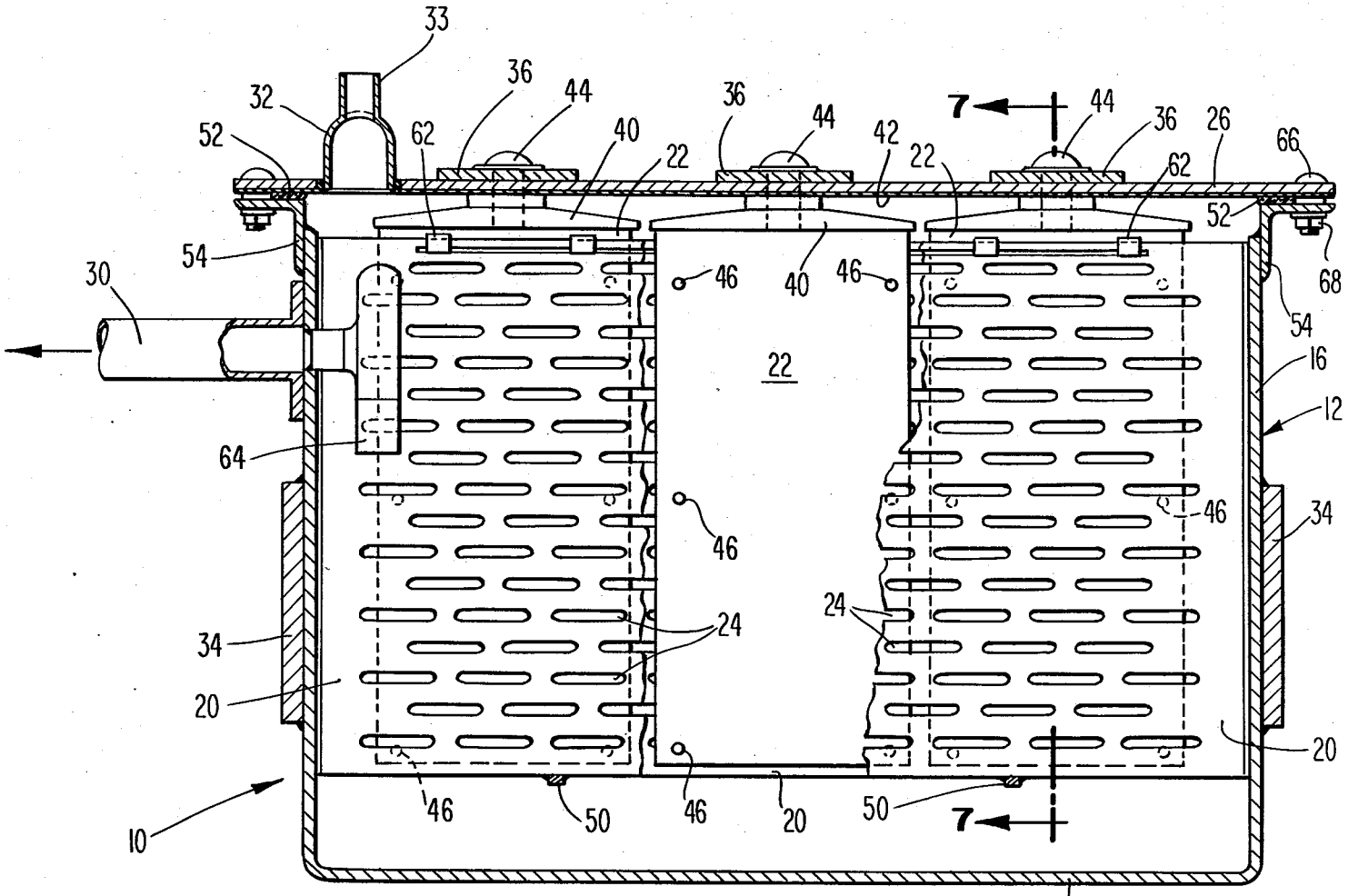
FIG. 5 is a partially broken side sectional view taken as indicated by arrows 5—5 in FIG. 4.

Referring to FIGS. 3 and 5, the cell is designated 10 and includes a can designated 12 which forms three of five sides of a tank within which the anode and cathode electrodes of the cell reside. Can 12 is a single piece of electrically conductive material, preferably carbon steel, and has a bottom 14 and two sides each designated 16. To form the tank, two side plates designated 18 are secured, preferably by welding, along their vertical and bottom margins to can sides 16 and can bottom 14. The tank top is closed by bolting headboard 26 (1) to flanges 54 which are secured, preferably by welding, to can sides 16 and (2) to horizontal upper portions of side plates 18 formed by bending. Headboard 26 is electrically conductive, preferably carbon steel.

Headboard 26 is electrically insulated from the lower portion of the tank by a gasket 52 mounted on horizontal upper portions of side plates 18 and on horizontal portions of flanges 54. Gasket 52 is maintained between headboard 26 and horizontal portions of flanges 54 and side plates 18 by nuts 68 in threaded engagement with bolts 66, as best illustrated in FIG. 6 Nuts 68 and bolts 66 also maintain the headboard on the tank. Each nut 68-bolt 66 combination is insulated from both the tank and the headboard by an insulative collar 70 and an insulative spacer 72. Collar 70 and spacer 72 may be any dielectric material which can withstand temperatures of up to 100° C occuring during cell operation.

Within the tank are a plurality of pairs of vertically oriented horizontally spaced substantially flat parallel perforate cathodes; each cathode has been designated 20. The cathodes are welded at their horizontally extreme vertically extending margins to the inside surfaces of can vertical sides 16. The cathodes are electrically conductive and preferably are carbon steel. Three anodes, each designated 22, reside within each pair of individual cathodes 20, with the anodes each substantially equally spaced from each cathode of the surrounding pair. The anodes are mechanically and electrically connected to headboard 26. The anodes are electrically conductive, preferably titanium, and are coated with a highly conductive precious metal coating. Although titanium is the preferred metal for the anodes, any metal from the titanium group, i.e. titanium, zirconium, tantalum and hafnium, may be used to fabricate the anodes. One supplier of a suitable precious metal alloy anode coating is Englehard Minerals and Chemicals Corporation, located in Union, N.J. The precious metal anode coating may also be platinum, a platinum-iridium alloy or ruthenium oxide.

Referring to FIG. 3, anodes 22 are secured to headboard 26 by bolts 24 which pass through anode bus plate 36. Each anode bus plate 36 on top of headboard 26 has a plurality of anodes connected thereto by bolts 24. All the anodes enter spaces between cathodes disposed in pairs when headboard 26 is lowered into place and secured to the tank, as shown by the arrows in FIG. 3. Thus when the cell is assembled a cathode-anode-cathode-cathode-anode-cathode-cathode-anode-cathode pattern results.

Anode-headboard assembly is best shown in FIG. 7. The top portion of each anode 22 resides within a channel in an anode header bar 40 with the anode and the header bar preferably welded together. Header bar 40 has a tapped hole for receipt of bolt 44. Bolt 44 secures an anode bus plate 36, Headboard 26, the preferably titanium headboard liner 42 and an anode header bar 40 together. An O-ring 48 seals each anode header bar-titanium liner interface. The anode header bars are preferably titanium.

Each anode has several holes therethrough with anode spacer buttons 46 secured therewithin. Anode spacer bottons 46 may be any electrically insulative material which can withstand high temperatures and the corrosive effects of alkali metal chlorides and alkali metal chlorates in solution. Both polyvinylidene fluoride and polytetrafluoroethylene are suitable materials for the anode spacer buttons. Buttons 46 serve as bumpers to maintain the anodes spaced from the surrounding cathode pair within which a particular anode resides. Anode spacer buttons 46 are preferably shaped so that an externally facing hemispherical configuration is provided for contacting a cathode 20. This is best shown in FIG. 8.

Figure 4:
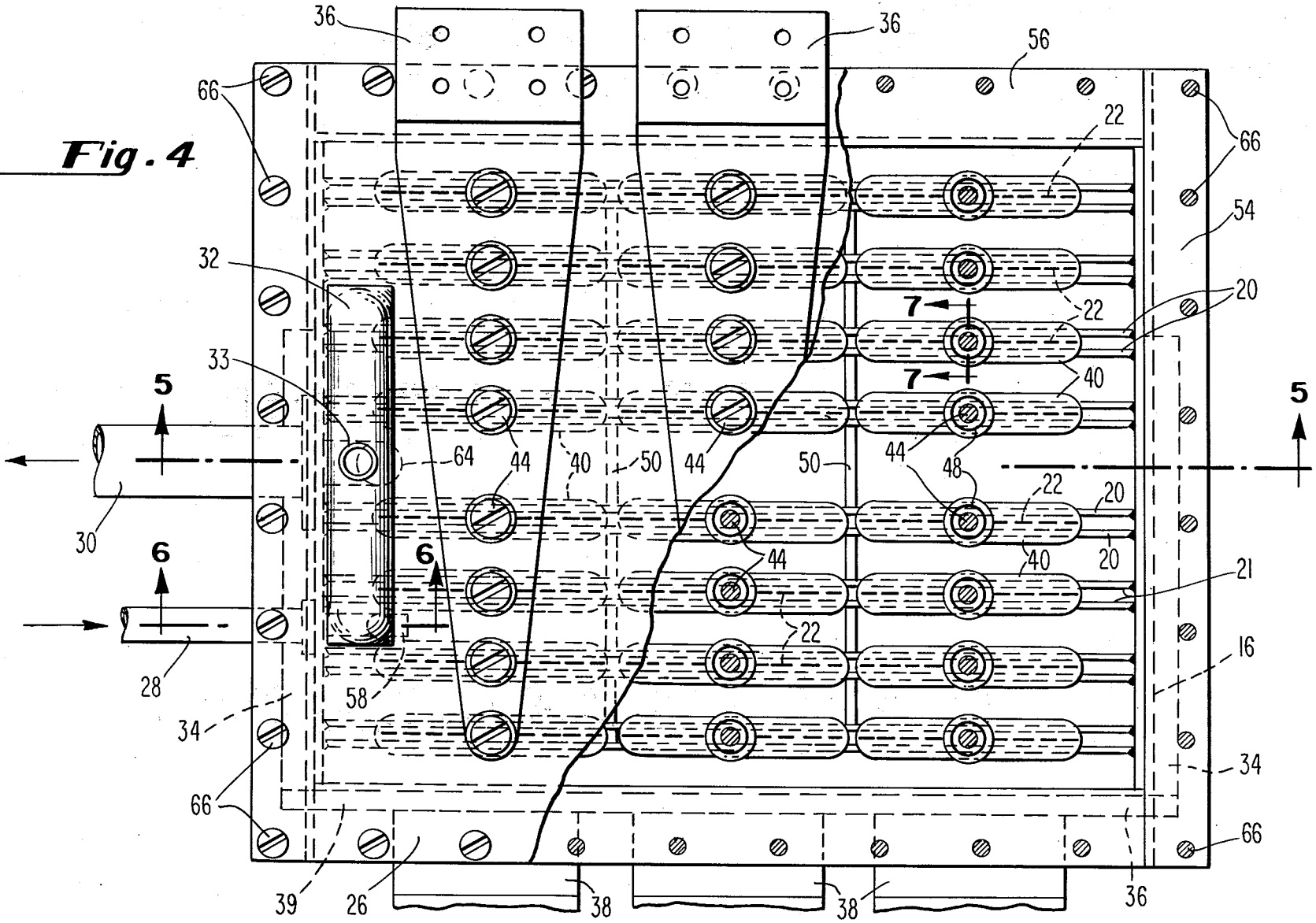
FIG. 4 is a partially broken top view of a cell embodying the invention.

Referring to FIGS. 3, 4 and 5, pairs of cathodes are designated 21, with each cathode electrically connected, preferably by welding, to can sides 16 along vertically extending edges. Each cathode of a pair is horizontally spaced from and parallel to its paired cathode mate. Stringers 50 welded to cathodes 20 along the cathode lower margins reinforce the assembly of cathodes 20 in the tank. Each cathode 20 has a plurality of horizontal slots 24 therethrough with the percentage of open area in each cathode about 30%. At the upper extremity of each pair of cathodes are cathode spacers 62 which may be any electrically insulative material which can withstand high temperatures and the corrosive effects of alkali metal chlorides and alkali metal chlorates in solution. Both polyvinylidene fluoride and polytetrafluoroethylene are suitable materials for spacers 62. The spacers 62, along with anode spacer buttons 46, maintain the anodes spaced apart from each cathode of the surrounding cathode pair. This is best illustrated in FIGS. 7 and 8.

Secured to the exterior of each of the two can sides 16 are cathode bus plates 34. This is best shown in FIG. 3. The cathode bus plates are preferably welded to the can sides and improve distribution of electrical current over the can side.

Figure 1:
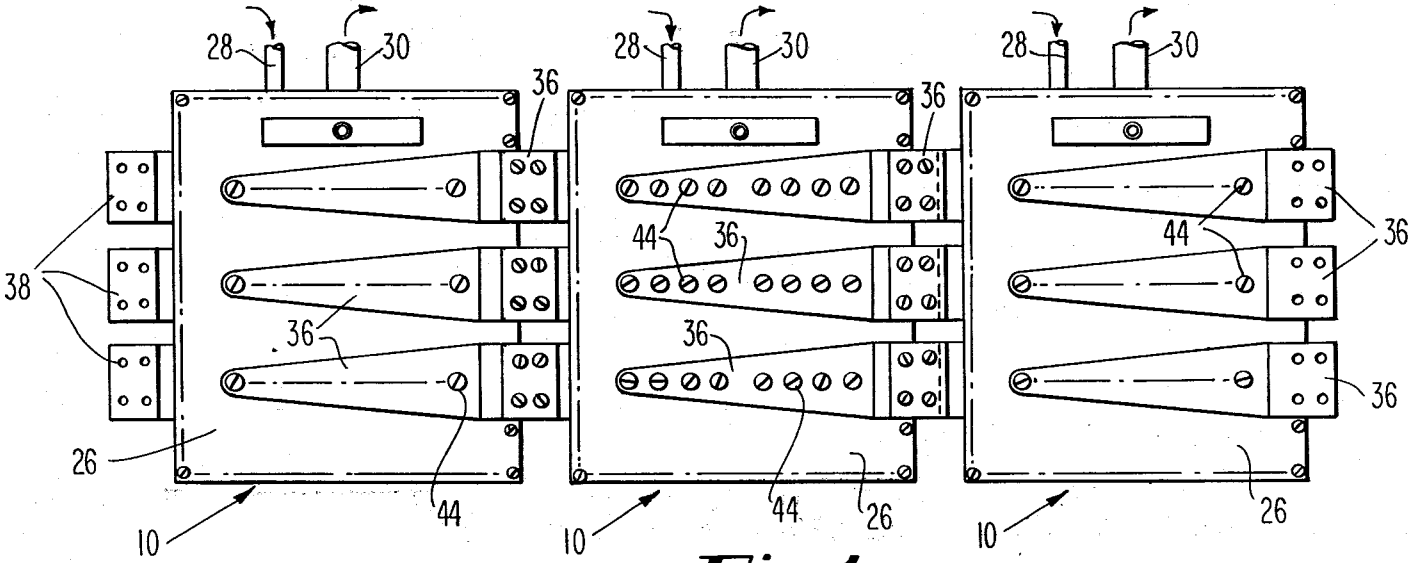
FIG. 1 is a top view of three cells, each embodying the invention, electrically connected in series.
Figure 2:
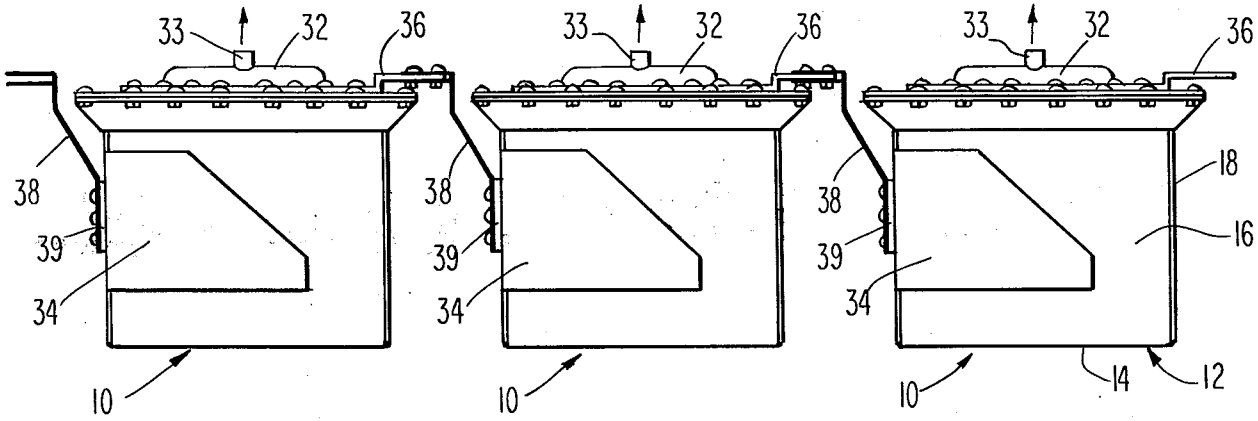
FIG. 2 is a front view of the three cells illustrated in FIG. 1.

Two or more cells may be electrically connected in series as illustrated in FIGS. 1 and 2. (All three of the cells illustrated in FIGS. 1 and 2 embody the invention. Some of the structural details, particularly some of bolts 44, have been omitted from the two end cells illustrated, as unnecessary for understanding the invention.) Cell interconnection bus 38 and cell interconnection bar 39, which is secured to a side plate 18 and to the two cathode bus plates 34, allow series connection of cells. Each cell interconnection bus 38 is connected to the anode bus plate of a first cell and the cell interconnection bar of a second, adjacent cell by bolts which have not been numbered.

A gas manifold 32 having a gas outlet pipe 33 is formed in headboard 26. Gas produced during electrolysis of alkali metal chloride brine collects in manifold 32 and is removed therefrom through outlet pipe 33. This structure is best shown in FIGS. 3 and 5.

Referring to FIG. 6, alkali metal chloride brine is introduced into the cell through a liquid inlet pipe 28. Feed pipe 58 conveys incoming liquid to the bottom area of the cell below the anodes and cathodes; the cell is allowed to fill with liquid to a level above the cathodes but slightly below titanium liner 42 of headboard 26. The liquid circulates through the cell and is removed through a liquid outlet feed pipe 64 connected to liquid outlet pipe 30; this structure is best shown in FIG. 5. Liquid-tight fittings are provided where the liquid inlet and outlet pipes pass through the cell walls.

During operation, a high current output DC voltage source is connected across the cell anodes and cathodes, with the DC voltage source positive leads connected to the anode bus bars (and therefore to the anodes) on the insulated top of one cell and the DC voltage source negative leads connected to either the cell interconnection bar 39 and therefore the lower tank portion of that cell, if only one cell is operated, or to cell interconnection bar 39 and therefore the lower tank portion of a second cell to which the first cell is electrically connected in series when two or more cells are operated. The number of cells which can be connected together in series is limited only by the available output current of the DC voltage source.

The cell has been constructed with adjacent pairs of cathodes separated, as shown by dimension "A" in FIG. 7, a distance of about 2½ inches, and with the cathodes forming a cathode pair separated from each other, as shown by dimension "B" in FIG. 7, a distance of about three-fourth of an inch. The cathodes have been fabricated of carbon steel and have been about 25 × 44 × 3/8 inches. The anodes have been fabricated of titanium, then coated with a precious metal coating and have been about 24 × 12 × 3/16 inches. As used herein, the term "about" when modifying dimensions means within engineering and fabrication tolerances. Slots 24 in the cathodes have been 1/2 inch high with slot ends configured as one-fourth inch radius circles. The centers of these circles have been separated by 3 inches, making for an overall slot maximum length of 3½ inches. Adjacent slots have been separated, in the vertical direction, by 1½ inches, measured between slot horizontal centerlines. Horizontally adjacent slots have been separated by 1½ inches, measured between centers of most adjacent slot end circles. The tank and headboard have been fabricated of one-half inch carbon steel while the headboard liner has been 18 gauge titanium. Cathode bus plate 34 has been fabricated of 1¾ inch carbon steel; cell interconnection bar 39 has been fabricated of 1 inch carbon steel with the surface facing away from the cell explosion-clad with one-eighth inch copper. Anode bus plates 36 have been fabricated of copper as has the cell interconnection bus 38.

Use of titanium as the anode base metal insures that an anode will not erode should a portion of the precious metal coating wear away during cell operation or be accidentally damaged during cell fabrication, assembly of maintenance. If the titanium base metal is exposed to the cell liquor, chlorine in the cell liquor attacks the titanium and a titanium oxide film forms at the titanium-liquid interface. The titanium oxide prevents further attack of the titanium base metal by the chlorine, thereby halting deterioration of the anode.

Surprisingly, cells embodying the invention, when operating at moderate to high cathode current densities and at moderate to high cell liquor temperatures produce alkali metal chlorates more efficiently than cells known heretofore, including the cell disclosed in the U.S. Pat. No. 3,824,172 patent, the most efficient previously known cell. Even more surprisingly, the efficiency advantage of cells embodying the invention over previously known cells increases both as cathode current density (and hence chlorate production rate) increases and as cell liquor temperature increases.

Figure 9:
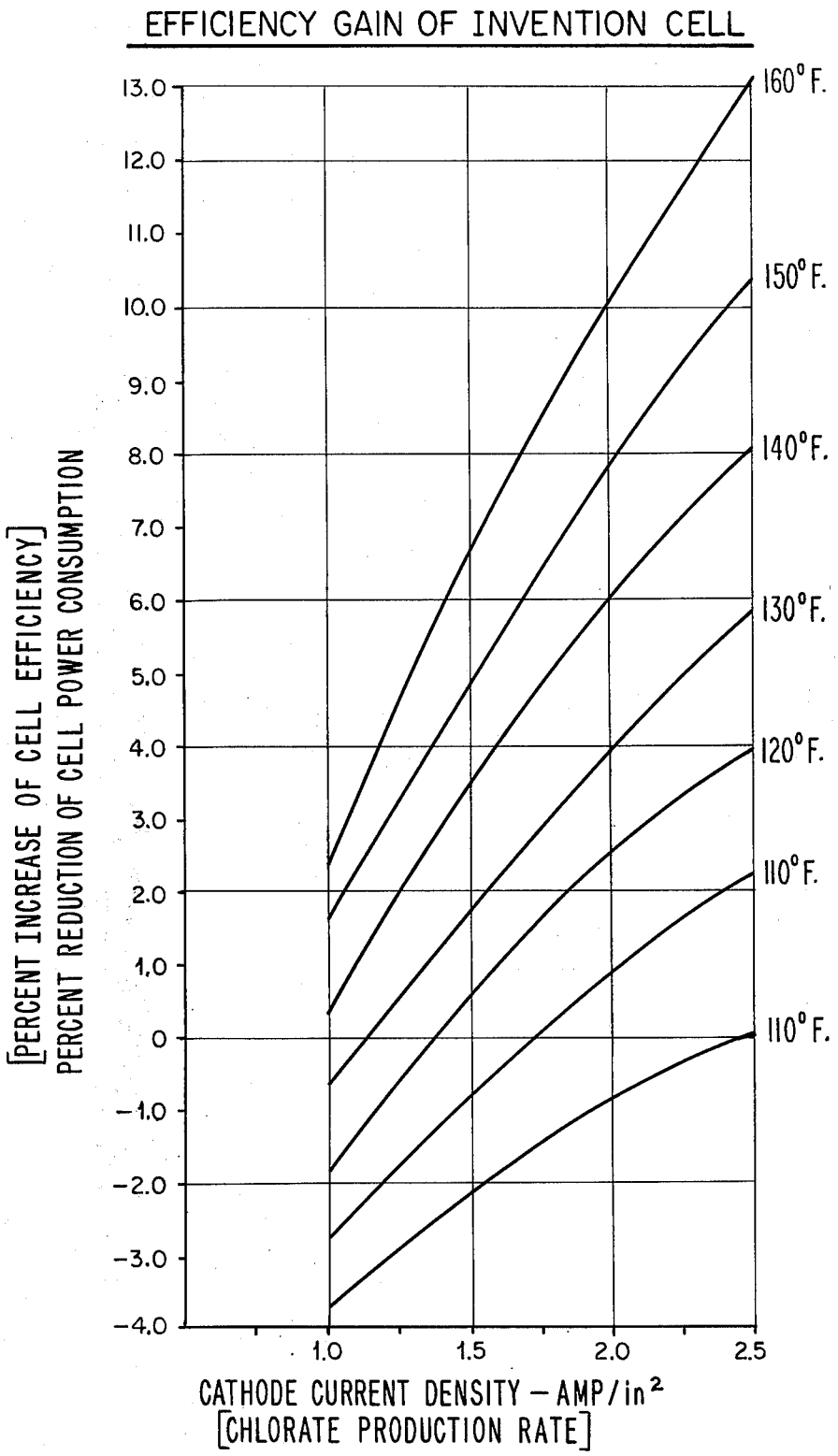
FIG. 9 is a graphic representation of the efficiency advantage of a cell embodying the invention over the most efficient cell known heretofore.

Interpolating between the curves illustrated in FIG. 9, at cathode current densities in excess of 1 ampere per square inch, cells embodying the invention produce alkali metal chlorate, specifically sodium chlorate, more efficiently than the cell disclosed in the U.S. Pat. No. 3,824,172 patent, so long as cell liquor temperature is maintained above 136° F. The efficiency advantage of cells embodying the invention increases as either or both cell liquor temperature and cathode current density increase, i.e. as the cell operating point is moved towards the upper right-hand corner of FIG. 9.

Cells embodying the invention also have a substantially longer service life than cells known heretofore. The limiting factor on service life of any diaphragmless electrolytic cell is loss of precious metal coating from cell anodes. To the extent that anode coating loss is minimized, service life of any diaphragmless electrolytic cell is maximized. Anode coating loss is primarily a function of current density at the anode surface. Current density, in turn, is a function of many variables, a primary one of which is metallic salt concentration over the anode area. If salt concentration is high, electrical conductivity of the solution is high and high amperage current flows between the cathodes and anodes. It may be desirable to maintain a high salt concentration and therefore high current density in the cell to obtain a high rate of chlorate production, at a cost of reduced anode coating life. No matter what the current density and no matter what the chosen rate of chlorate production, to produce chlorates efficiently with maximum anode life it is necessary to minimize salt concentration gradients in the cell. If a significant salt concentration gradient is allowed to exist within the cell, wherever a relative maximum salt concentration occurs, electrical conductivity of the liquid solution is high and more current flows from the cathode to the anode at that location. Such local high current flow can quickly consume the anode coating. Thus, to the extent metallic salt concentration gradients over the anode surface are minimized, current density variations over the anode surface are minimized and the anode coating wears evenly. This leads to longer anode life, no matter what the average salt concentration and average anode current density.

Anode coating loss has been measured in an experimental cell embodying the invention. Coating loss has been uniform over the anode surface. Extrapolation of measured anode coating loss rates indicates an expected anode coating life, and hence an expected cell service life, of from eight to ten years. This is substantially greater than service life of cells known heretofore.

Improved efficiency and longer service life of cells embodying the invention result from a minimized metallic salt concentration gradient within the cell, produced by the combination of (1) closely spaced adjacent cathode pairs and (2) horizontal slots through individual cathodes. Close spacing of cathode pairs and the horizontal slots through the cathodes bring about improved cell efficiency and longer cell service life by providing improved hydraulics within the cell and improved gas disengagement from the cathodes. The close spacing of the cathode pairs and the horizontal slots through the cathodes each independently contribute to both the improved cell hydraulics and the improved gas disengagement.

Close spacing of adjacent cathode pairs improves cell hydraulics by forcing rapid movement of cell liquor along cathode and anode surfaces as the liquor flows through the tank. The cell liquor, moving at a high flow rate, efficiently removes gas which forms at and adheres to the cathodes during electrolysis of alkali metal chloride brine. Removal of gas as the liquid rises through the cell assures maintenance of a uniform metallic salt concentration gradient along the vertical length of the anodes. If gas were allowed to remain on the cathodes, no current could flow to an anode from the cathode area covered by gas, an effect known as "gas blinding." With gas effectively removed from between the anodes and cathodes, electrical resistance through the brine from the cathodes to the anodes is uniform, and the entire area of each cathode transmits current through the brine. This effectively reduces cathode-anode voltage drop at any current density, thereby reducing cell power consumption for the chosen chlorate production rate, and assures that electrolysis of brine is reasonably uniform along the vertical length of the anodes and cathodes.

Horizontal slots through the cathodes improve gas disengagement from the cathodes. Since the cell liquor moves generally vertically through the cell, from below the cathodes to the cell top, gas formed on the cathodes tends to move vertically up the cathode surfaces. When gas bubbles moving along a cathode surface encounter a horizontal slot, the gas bubbles disengage from the cathode and float upward through the cell liquor. Indeed, the rising gas bubbles act as a pump, accelerating liquid flow upward through the cell. As gas bubbles disengage from the cathodes, the gas bubbles, being less dense than the liquid, reduce effective local density of the liquid. The portion of lighter liquid floats upward between the cathodes or between a cathode and an anode, effectively forcing more liquid to flow along cathode and anode surfaces thereby "pumping" liquid through the cell.

Horizontally-slotted cathodes provide a major improvement over vertically-slotted cathodes and over cathodes with no slots. Gas can flow upward along the surfaces of both vertically-slotted cathodes and cathodes having no slots, with gas thereby remaining in contact with the cathode when the gas reaches the cathode vertical wetted extremity. This results in gas blinding with consequent reduction in cell efficiency. The horizontal slots prevent this in cells embodying the invention.

As a further advantage, horizontal slots in the cathodes eliminate the need for cathode current distribution bars such as bars designated 30 in the U.S. Pat. No. 3,842,172 patent. This allows adjacent cathode pairs to be very closely laterally spaced and also facilitates improved current distribution over the horizontal length of the cathode. In cells embodying the invention each portion of solid cathode area between vertically adjacent rows of horizontal slots acts as an individual current distribution bar, distributing current uniformly along the horizontal length of the cathode.

The cell layout, featuring close spacing both of cathodes about anodes and of adjacent cathode pairs, and the horizontal cathode slots synergistically contribute to improved cell hydraulics and better gas disengagement (with resultant minimized metallic salt concentration gradients, minimized current density variations and maximized cell efficiency) than known heretofore in diaphragmless electrolytic cells. The synergism begins with the horizontal slots promoting gas disengagement from the cathode. As the gas disengages, it reduces effective density of liquid surrounding the cathode, in the neighborhood where gas disengagement occurs. The resulting low density lightweight liquid rises through surrounding higher density liquid, effectively increasing rate of liquid flow along the cathode. Since the cathodes are closely spaced, liquid velocity along the cathodes is high, higher than in prior art cells. Higher liquid velocity in turn promotes more gas disengagement which in turn further increases liquid velocity. All of this synergistically contributes to greater cell efficiency than available in cells known heretofore.

I claim the following:

1. An electrolytic cell for producing alkali metal chlorates from alkali metal chloride brine, comprising:

(a) an electrically conductive tank including a top electrically insulated from a lower portion of the tank;

(b) a plurality of pairs of perforate cathodes within said tank, each cathode of a pair spaced from and parallel to its paired cathode mate, vertical margins of said cathodes welded to vertical walls of said tank lower portion, perforations through each cathode forming a plurality of horizontal slots;

(c) a plurality of imperforate anodes electrically connected to and suspended from said tank top, resident between cathode mates forming said cathode pairs, at least one anode resident between cathode mates of each cathode pair, each anode spaced apart from the two cathode mates of the associated cathode pair, said cathodes and anodes thereby forming a cathode-anode-cathode-cathode-anode-cathode-cathode-anode-cathode pattern;

(d) means for applying a DC voltage between said insulated tank top and said tank lower portion;

(e) means for introducing alkali metal chloride brine into said tank, below said anodes and cathodes; and (f) means for withdrawing, from said tank, alkali metal chloride-chlorate liquor produced by electrolysis of said brine.

2. The cell of claim 1 wherein said cathodes are vertically oriented, horizontally spaced and substantially flat and wherein said anodes are vertically oriented, horizontally spaced and substantially flat.

3. The cell of claim 1 further comprising a plurality of electrically insulative chemically resistive bumpers on either side of each anode, for maintaining said anodes spaced apart from cathode mates of a cathode pair within which an anode resides.

4. The cell of claim 1 wherein anodes resident within cathode pairs are equally spaced from each mated cathode of the associated cathode pair.

5. The cell of claim 1 further comprising a raised manifold, formed in said insulated top, for collecting any gas produced at said anodes and cathodes during electrolysis of said brine.

6. The cell of claim 1 wherein said cathodes are carbon steel.

7. The cell of claim 1 wherein said anodes are fabricated from a metal selected from the group consisting of titanium, zirconium, tantalum and hafnium.

8. The cell of claim 1 further comprising a plurality of cast titanium header bars, one bar per anode, each bar interposed between an anode and said tank top, in engagement with an anode top surface.

9. The cell of claim 2 wherein said tank has its bottom and two sides formed of a single metal member.

10. The cell of claim 4 wherein said bumpers are formed of a material selected from the group consisting of polyvinylidene fluoride and polytetrafluoroethylene.

11. The cell of claim 6 wherein said anodes are titanium coated with a precious metal alloy.

12. The cell of claim 7 wherein the anodes are coated with a coating selected from the group consisting of platinum, platinum-iridium alloy and ruthenium oxide.

* * * * *